United States Patent [19]

Doyle

[11] 4,380,232

[45] Apr. 19, 1983

[54] WHISTLE ATTACHMENT FOR A SNORKEL, AND SNORKEL-WHISTLE UNIT

[76] Inventor: James J. Doyle, 699 NE. 164th St., Miami, Fla. 33162

[21] Appl. No.: 263,496

[22] Filed: May 14, 1981

[51] Int. Cl.[3] ..... A62B 7/00

[52] U.S. Cl. ..... 128/201.11

[58] Field of Search ..... 128/201.11, 201.19, 128/203.15, 200.23; 46/179, 175

[56] References Cited

U.S. PATENT DOCUMENTS

| | | | |
|---|---|---|---|
| 3,066,443 | 12/1962 | Mobley | 46/179 |
| 3,139,087 | 6/1964 | Liberatore | 128/145 |
| 4,066,077 | 1/1978 | Shamlian | 128/145 |

FOREIGN PATENT DOCUMENTS

| | | | |
|---|---|---|---|
| 21103 | of 1909 | United Kingdom | 128/201.19 |

*Primary Examiner*—Henry J. Recla

*Attorney, Agent, or Firm*—Oltman and Flynn

[57] ABSTRACT

A generally J-shaped snorkel tube with a mouthpiece at its lower end carries an attached whistle on one side near its upper end. The whistle is in a hollow projection on one side of a sleeve that is slidably inserted over the upper end of the snorkel tube. The whistle and sleeve are a separately formed attachment for a conventional snorkel. The whistle does not obstruct the top opening in the snorkel tube through which the use can expel water from the snorkel by blowing into the mouthpiece. The user covers this top opening with one hand when blowing the whistle.

6 Claims, 5 Drawing Figures

Fig. 2
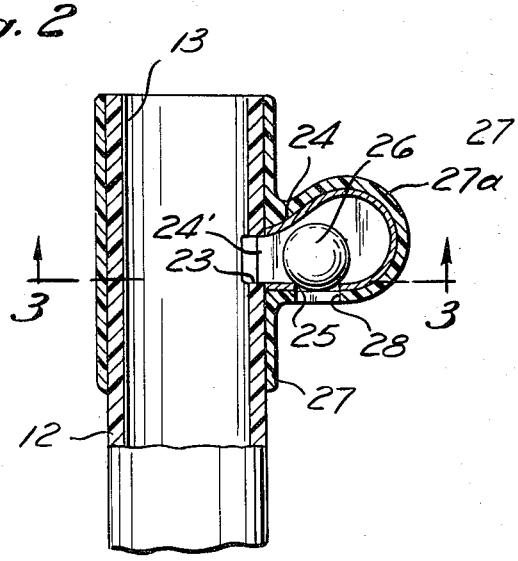
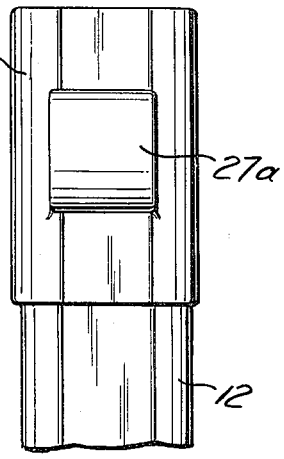
Fig. 4
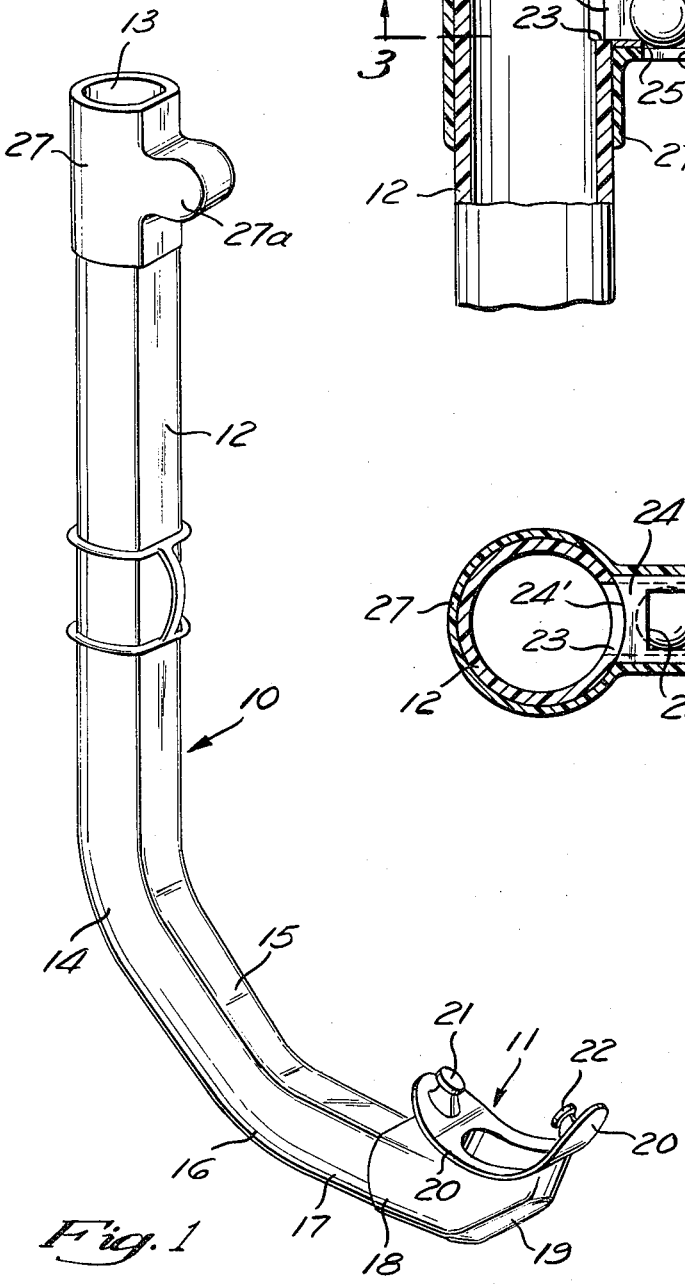
Fig. 1
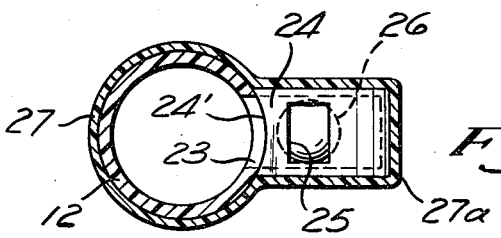
Fig. 3
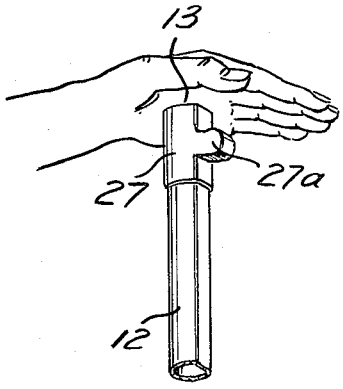
Fig. 5

WHISTLE ATTACHMENT FOR A SNORKEL, AND SNORKEL-WHISTLE UNIT

SUMMARY OF THE INVENTION

This invention relates to a whistle attachment for a snorkel used by a skin diver or swimmer. The diver, while submerged, may blow the whistle through the snorkel to provide an audible signal to others, such as in an emergency or for some other reason to call them to where the diver is located.

In accordance with the present invention, the whistle attachment can be mounted on the snorkel tube at its upper end in such a manner as not to obstruct the normally open top opening in the snorkel tube. This is a very important safety consideration because it enables the diver to blow out of the snorkel tube any water that inevitably collects in the bottom of the snorkel and might lead to difficulty in breathing through the snorkel or even to drowning. The whistle is located at one side of the snorkel tube and has an inlet passage communicating with the interior of the snorkel tube through an opening in the side wall of the snorkel tube. When the normally open end of the snorkel tube is in its normal unobstructed condition, the whistle will not sound when the diver blows into the mouthpiece and the whistle will not interfere with the ejection of water from the snorkel. However, when the diver wants to use the whistle, he can place the palm of his hand across the upper end of the snorkel tube to block it and thereby divert his breath from the interior of the snorkel tube into the whistle for operating it when he blows into the mouth-piece.

A principal object of this invention is to provide a whistle attachment for a snorkel which does not detract from the user's ability to blow water out of the snorkel when necessary for his convenience or safety.

Another object of this invention is to provide a unitary snorkel and whistle which the user may operate selectively either to blow water out of the snorkel without interference by the whistle or to blow the whistle.

Further objects and advantages of this invention will be apparent from the following detailed description of a presently preferred embodiment thereof, which is shown in the accompanying drawing.

DESCRIPTION OF THE DRAWINGS

FIG. 1 is a perspective view of a snorkel having a whistle attachment in accordance with the present invention;

FIG. 2 is a fragmentary longitudinal section through the upper end of the snorkel where the whistle is attached;

FIG. 3 is a cross-section taken along the line 3—3 in FIG. 2;

FIG. 4 is a fragmentary elevational view taken from the right side of FIG. 3; and FIG. 5 is a perspective view showing how the user blocks the normally open upper end of the snorkel with his hand to enable the whistle to be operated.

DETAILED DESCRIPTION

The snorkel 10 is of known design, consisting essentially of a generally U-shaped tube carrying a mouthpiece 11 at its lower end.

In the particular embodiment shown the snorkel tube has an elongated straight leg 12 which should extend substantially vertical when the snorkel is in use by a skin diver or swimmer. As shown in FIG. 2, this straight leg terminates in an opening 13 at its upper end which is unobstructed. The lower end of the elongated straight leg 12 merges smoothly at a bend 14 with a shorter oblique segment 15, which extends at an angle of about 45 degrees downward and to the right in FIG. 1. At its lower end this oblique segment 15 merges smoothly at a bend 16 with a short horizontal segment 17, which extends substantially perpendicular to the elongated leg 12.

The mouthpiece 11 has a short, horizontal, hollow neck 18 which snugly receives the outer end of the horizontal segment 17 and is bonded to it in fluid-tight fashion. Away from the horizontal segment 17 of the snorkel tube the mouthpiece is bent upwardly at 19 so as to complete a reverse bend in the lower end of the snorkel, beginning at the bend 14 and continuing through the oblique segment 15, the lower bend 16 and horizontal segments 17 and 18. The mouthpiece has an arcuate flange 20 adapted to fit inside the user's lips at the front of his teeth. End tabs 21 and 22 on this flange can be gripped between the user's molars. The mouthpiece 11 is flexible and resilient, particularly at the flange 20 and tabs 21 and 22.

The snorkel tube 12, 14, 15, 16, 17 is sufficiently rigid to normally support itself in the position shown but it is sufficiently flexible to be readily bent out of shape, returning to its normal shape when the bending force is removed because of its plastic memory.

In accordance with the present invention, a whistle attachment for the upper end of the snorkel comprises a hollow sleeve 27 which fits slidably but snugly around the open upper end of the elongated leg 12 of the snorkel tube, as best seen in FIGS. 2 and 3. At one side this sleeve carries an integrally formed, hollow projection **27*a* which snugly surrounds a hollow, metal whistle body 24 of conventional design. The whistle body 24 has an open inner end 24' which registers with an opening 23**, which is formed in the side wall of the snorkel tube in accordance with the present invention.

The whistle body has a bottom opening 25 (FIG. 2) located a short distance laterally outward from the side wall of the snorkel tube. The hollow projection **27*a* on sleeve 27 has a bottom opening 28 which registers with the bottom opening 25 in the whistle body. A ball 26 loosely received inside the whistle body 24 normally closes the aligned bottom openings 25 and 28. This ball is substantially smaller than the interior of the whistle body 24 so that it can move away from the bottom opening when the user's breath is forced into the open end 24'** of the whistle body.

Preferably, the whistle 24, 26 and the sleeve 27 with its hollow enlargement **27*a* holding the whistle body constitute a separately formed unit which may be slipped onto the upper end of any snorkel tube of conventional design. The only structural modification that need be made in the snorkel tube itself is to provide the opening 23 in its side wall. After being slidably assembled onto the upper end of the snorkel tube, the sleeve 27 may be bonded to it by any suitable adhesive with the inlet opening 24' in the hollow whistle body registering with the side opening 23 in the snorkel tube, as shown in FIGS. 2 and 3**.

In the use of the assembled snorkel and whistle, whenever a skin diver or swimmer using the snorkel wants to give an audible signal, he first places the palm of one hand across the top opening 13 to block it as shown in FIG. 5. Then, when he blows into the snorkel mouthpiece 11 his breath will enter the whistle body at 24' and will unseat the ball 26 and produce a whistling sound at the outlet openings 25 and 28 in the bottom of the whistle body 24 and the sleeve projection 27*a*. Except under these conditions, (i.e., when the user is blowing the whistle) the upper end opening 13 of the snorkel will be unobstructed, making it possible for the user to expel water from the snorkel in the usual manner by blowing into the mouthpiece 11. This is extremely important from the safety standpoint because of the practically unavoidable tendency for water to accumulate in the lower end of the snorkel, necessitating its removal from time to time to enable proper breathing through the snorkel and avoid the ingestion of water into the user's lungs, possibly causing drowning.

I claim:

1. On a snorkel having a generally J-shaped tube with a return bend at its lower end and a mouthpiece at the extremity of said return bend, said tube defining a passage extending continuously from said mouthpiece to its upper end, the improvement which comprises:

means forming a side opening in said tube near its upper end communicating with said passage;

a breath actuated whistle mounted on one side of said tube near its upper end and having an inlet opening registering with said side opening and thereby communicating with said passage through said tube;

said tube terminating at its upper end in an unobstructed opening leading up from its passage and extending across substantially the full width of said passage to permit the user to expel water which accumulates in the lower end of the snorkel by flowing into the mouthpiece, and said opening being closable by the user's hand to direct the user's breath into the whistle when the user blows into the mouthpiece.

2. A snorkel according to claim 1, wherein said whistle comprises a hollow body mounted on one side of said tube near the latter's upper end, said hollow body having an inlet opening which opens into the interior of the tube at said one side of the latter and an air outlet opening in the bottom spaced laterally outward from said side of the tube.

3. A snorkel according to claim 2, wherein said whistle also includes a ball loosely received in said hollow body and normally overlying said outlet opening in the bottom of said hollow body.

4. For use on a snorkel having a generally J-shaped tube with a top opening in its upper end and a side opening near its upper end, said tube having a return bend at its lower end and a mouthpiece at the extremity of said return bend, said tube defining a longitudinal passage extending continuously from said mouthpiece to said top opening in its upper end and communicating with said side opening in the tube near its upper end, a whistle attachment comprising:

a sleeve snugly but slidably insertable over the upper end of said tube, said sleeve having a hollow projection at one side which has an opening at its laterally inward end which is registrable with said side opening in the tube when said sleeve is on the upper end of said tube;

and a whistle body held snugly in said hollow projection on the sleeve, said whistle body having an inlet opening at its laterally inward end inside said opening in the sleeve, both of which are registrable with said side opening in the snorkel tube when said sleeve is on the upper end of the snorkel tube, and said whistle body and said hollow projection on the sleeve having registering outlet openings located laterally outward from said inlet opening.

5. A whistle attachment according to claim 4, wherein said outlet openings are on the bottom of said hollow whistle body and said hollow projection on said sleeve.

6. A whistle attachment according to claim 5, and further comprising a ball loosely received in said hollow whistle body and normally overlying said outlet opening in the bottom of said whistle body.

* * * * *